US006749148B2

(12) United States Patent
Helfer-Grand

(10) Patent No.: US 6,749,148 B2
(45) **Date of Patent: *Jun. 15, 2004**

(54) COMMERCIALLY MODELED PORTABLE TOWELETTE DISPENSER SYSTEM WITH SENSOR MEANS

(75) Inventor: Beverly Helfer-Grand, Huntington Station, NY (US)

(73) Assignee: Dr. Beverly Helfer-Grand Lifeworks, Inc., Huntington Station, NY (US)

( * ) Notice: Subject to any disclaimer, the term of this patent is extended or adjusted under 35 U.S.C. 154(b) by 222 days.

This patent is subject to a terminal disclaimer.

(21) Appl. No.: 09/747,771

(22) Filed: Dec. 23, 2000

(65) Prior Publication Data

US 2001/0006206 A1 Jul. 5, 2001

Related U.S. Application Data

(63) Continuation-in-part of application No. 09/187,493, filed on Nov. 6, 1998, now Pat. No. 6,213,424.
(60) Provisional application No. 60/064,810, filed on Nov. 7, 1997.

(51) Int. Cl.[7] ..... B65H 19/16; B67D 1/07
(52) U.S. Cl. ..... 242/564.1; 242/563; 222/192
(58) Field of Search ..... 242/563, 563.2, 242/564.1, 564.4, 591; 222/192, 146.5; 239/239, 289, 135, 99; 219/214, 386, 521

(56) References Cited

U.S. PATENT DOCUMENTS

| | | | | |
|---|---|---|---|---|
| 2,374,103 A | * | 4/1945 | Johnson | 242/591 |
| 2,626,109 A | * | 1/1953 | Hart | 242/591 |
| 4,826,262 A | | 5/1989 | Hartman et al. | |
| 5,244,263 A | | 9/1993 | Kennedy | 312/34.11 |
| 5,375,920 A | | 12/1994 | Macchi Cassia | 312/34.17 |
| 5,573,318 A | | 11/1996 | Arabian et al. | 312/34.11 |
| 5,601,253 A | | 2/1997 | Formon et al. | 242/595.1 |
| 5,836,862 A | | 11/1998 | Granger | 312/43.1 |
| 5,865,395 A | | 2/1999 | Wei | 312/34.16 |
| 5,979,822 A | | 11/1999 | Morand et al. | 312/34.19 |
| 6,007,168 A | | 12/1999 | Gaide | 312/34.6 |
| 6,098,917 A | | 8/2000 | Cruz | 312/34.8 |
| 6,105,898 A | | 8/2000 | Byrd et al. | 312/34.8 |
| 6,213,424 B1 | * | 4/2001 | Helfer-Grand | 242/564.1 |

* cited by examiner

*Primary Examiner*—William A. Rivera

(57) ABSTRACT

A user-activated, dispenser of pre-moistened, antiseptic towelettes appropriate for hand cleansing use in such contexts as food service, health care, long-term care, child care, educational settings, industry, military, and public restrooms. The dispenser contains two compartments. One is used for towelette-dispensing and the other can be optionally used for housing hand drying means or for storing a reserve supply of towelettes. Each compartment is configured according to operant and classical conditioning strategies that motivate sustained positive changes in both the frequency and effectiveness of hand washing behavior. Optionally, the present invention dispenser can also comprise towelette warming means, a retractable handle, and a sanitary towelette or paper towel disposal assembly. A sensor on the dispenser, triggered by badge proximity to the dispenser housing can provide data for performance feedback and reinforcement/accountability strategies, the performance feedback being documented by research as essential for sustained changes in hand cleansing behavior. Alternative mounting means provide versatility in secure dispenser placement on counter/desks; under cabinets; on pedestals; and on either front, left or right facing walls in a bathroom stall.

20 Claims, 3 Drawing Sheets

COMMERCIALLY MODELED PORTABLE TOWELETTE DISPENSER SYSTEM WITH SENSOR MEANS

CROSS REFERENCE TO RELATED APPLICATIONS

This application is a continuation in part of U.S. application Ser. No. 09/187,493, filed Nov. 6, 1998 now U.S. Pat. No. 6,213,424, which is included herein by reference. U.S. application Ser. No. 09/187,493 has the effective filing date of a provisional application 60/064,810, filed Nov. 7, 1997.

STATEMENT REGARDING FEDERALLY SPONSORED RESEARCH

NOT APPLICABLE

BACKGROUND OF THE INVENTION (1) Field of the Invention

This application is a continuation of U.S. application Ser. No. 09/187,493, filed Nov. 6, 1998, which is included herein by reference. The present invention relates generally to sheet or web dispensers, and more particularly to a dispenser apparatus for use in dispensing antiseptic, pre-moistened towelettes that are stored in either web or sheet form.

(2) Description of the Related Art

Infectious diseases remain the leading cause of death, world-wide, and the third leading cause of death in the United States. Voluminous authoritative research conducted during the last 150 years, by an array of pertinent disciplines, agencies and industries concur that frequent hand washing is the single-most reliable means for preventing the spread of infectious diseases.

Unfortunately, voluminous authoritative research also continues to reveal an abhorrent failure in compliance with this seemingly benign edict. Among the most intensely studied contexts—the health care, child care, elder-care, and food services industries, workers have been found to wash their hands in approximately 30% of required instances. Further, studies indicate that 30% of all food poisoning incidents recorded occur in the home, and at least 70% of these are hand transmitted, person-to-person, fecal-to-oral incidents.

Particularly during the last two decades, the United States has been confronted with the following on-going conditions: (1) growing numbers of emergent and re-emergent pathogens which are attacking with greater "stealth" force, and with an unprecedented unpredictability; (2) increasing numbers of multi-drug resistant pathogens; (3) swelling populations of vulnerable immuno-compromised patients; (4) indiscriminate use of antibiotics, contributing to their growing impotence; (5) high-load pathogen sites which defy familial socioeconomic boundaries; (6) an estimated 70% of transmission of pathogenic microbes via hand-transmission, primarily person-to-person, fecal-to-oral route; (7) the dissolution of our own health care infrastructure, such that it is an acknowledged contributor to the emergence and re-emergence of multi-drug resistant pathogens; and (8) globalization of infectious diseases previously limited by geographic boundaries.

Numerous commercial establishments are required either by law, civil liability, or a sense of moral obligation to make certain that their workers are washing their hands, resulting in the need for a means by which employers are able to monitor their workers to ensure that proper hand washing takes place.

Many inventions that have attempted to address the above-stated problems through facilitated hand washing have lacked the necessary portability that would allow it to change human behavior and implement the level of hand washing required to reverse and diminish the spread of infectious diseases.

U.S. Pat. No. 4,826,262 to Hartman et al. discloses an electronic towel dispenser with a sensor that dispenses towels caused by the movement of the towel by the user, however, the device of Hartman does not disclose towels that are pre-moistened with an antiseptic lotion, nor does it disclose a sensor that records data.

U.S. Pat. No. 6,105,898 to Byrd et al. also discloses a paper towel dispenser that is activated by a variable resistance photo sensor. However, the sensor disclosed in Byrd also does not records data.

U.S. Pat. No. 5,573,318 to Arabian et al. discloses a towel dispenser that records acts of use and adapts flexibility to external circumstances. However, the microprocessor records use patterns for preventing used towels from being dispensed, preventing dispensing when it is not queried, and the microprocessor does not record specific data relating to particular users.

No invention is known for facilitating an increase in the frequency of hand washing as a means for preventing the spread of infectious disease, that provides all of the advantages disclosed in and exhibited by the present invention.

BRIEF SUMMARY OF THE INVENTION

It is an object of the present invention to provide a dispensing apparatus for pre-moistened antiseptic towelettes stored in sheets or in web form that renders frequent hand cleansing feasible, and motivates positive sustained changes in hand washing behavior via integral operant and classical conditioning strategies built into actual products. It is also an object of this invention to provide a dispensing apparatus that is adaptable to the numerous commercial environments in which frequent hand-washing is required, including but not limited to, nursing homes, food preparation facilities, and medical establishments. It is also and object of this invention to provide a dispensing apparatus that allows monitoring of its usage by different individuals, so that a behavior modification program can be implemented when recorded activity demonstrates such a need.

Most vital among its multiple uses, the dispensing system of the present invention makes frequent and effective hand washing realistic and practical. In this capacity, the inventive apparatus provides the tools for strategic intervention to "break the chain of contagion" of hand-transmitted infectious diseases. This means, for example, that many food-borne pathogens, which we carry on our own contaminated hands, will be killed before exposure to the vulnerable mucosal membranes of the mouth, nose, and eyes. Hand transmission is one of the major forms of contagion responsible for the spread of infectious diseases. In the case of eating, hand transmitted pathogens easily become "food-borne" pathogens. In this common situation, we literally "self-inoculate".

One of the paramount obstacles to frequent hand washing, using traditional methods, has been that the traditional methods are time and labor intensive. Consequently, many people neglect to wash their hands at all. In addition, it is common for traditional hand washing methods to be responsible for incomplete hand de-contamination, as well as virtually instantaneous hand recontamination, for example, during exit from a bathroom when newly washed hands come in contact with door handle hardware on a bathroom door.

The present invention system provides a compact, durable, safe, reliable, portable, and multi-purpose anti-microbial weapon. It dispenses, either at room temperature or warmed, individual, broadly germicidal, biodegradable, sturdy yet soft, soothing, moisturizing and healing, flushable pre-moistened towelettes for sanitary/antiseptic cleansing of skin on hands, and face, as well as on many other parts of the human anatomy. In addition to dispensing pre-moistened, perforated towelettes, the present invention system optionally may include a hand drying assembly, a sanitary disposal compartment for used towelettes, and a sensor adapted for interaction with badges that permit verification of system use for those wearing such badges. The apparatus is of a size and shape that permits it to be mounted in any of a number of different orientations and any convenient mounting structure can be employed to secure the housing in any of these orientations.

The present invention system differs from traditional hand-washing methods in many significant ways, including the following: (1) Hand cleansing is completed significantly faster with the present invention; (2) The present invention provides all necessary "ingredients" for antiseptic, moisturizing, healing hand washing in the form of a conveniently available in a compact, self-contained unit; (3) During use of the present invention hand cleansing evolves from being a burden, into an easy, pleasurable, and habitual experience; (4) When the present invention includes a means of sanitary disposal for used towelettes, the present invention also prevents unwitting contamination of other sites or persons; (5) Cost in human energy usage regarding the cleansing of self and hands of children is greatly reduced using the present invention; (6) Children can more reliably be taught autonomy in disease prevention for self/wellness because the present invention is easy to use and feels good, providing a positive reinforcement effect; (7) Children and adults are repeatedly influenced by the present invention to remain aware that their personal hygiene can have a most serious impact on their own well-being as well as the well-being of others; (9) Through use of the present invention human suffering and needless loss of lives can be significantly diminished, and a great deal of the enormous costs associated with the spread of infectious diseases attributed to incomplete hand washing can be put to far more constructive use; and (10) Through use of the present invention a system is provided that easily adapts to different cultures for global use.

BRIEF DESCRIPTION OF THE SEVERAL VIEWS OF THE DRAWINGS

The preferred embodiment of the present invention is described in detail below with reference to the attached drawings, wherein.

DETAILED DESCRIPTION OF THE INVENTION

Figure 1:
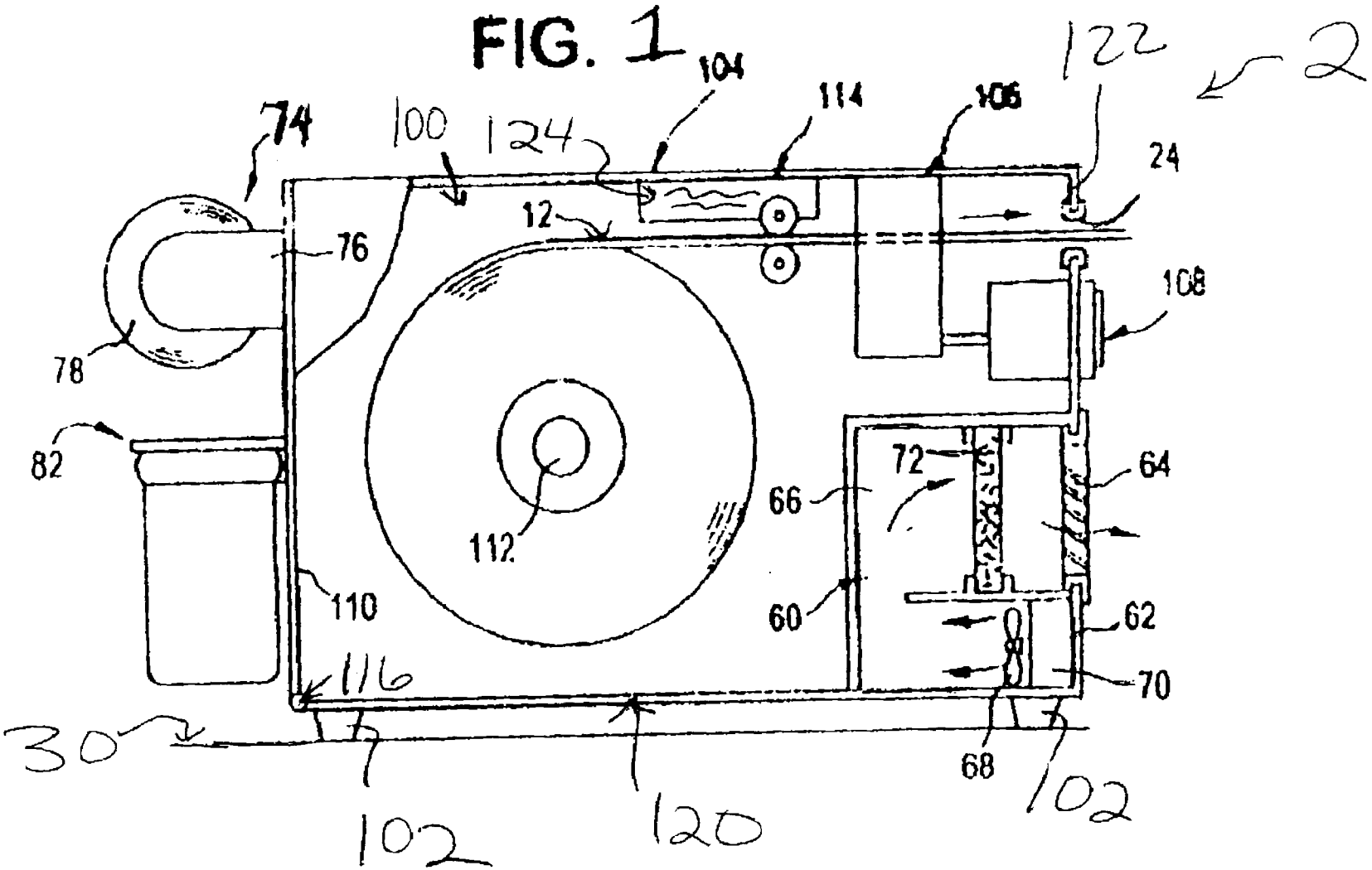
FIG. 1 is a sectional side view of the dispensing apparatus constructed in accordance with the most preferred embodiment.

A dispenser system 2 constructed in accordance with the preferred embodiment of the present invention is illustrated in FIG. 1, and broadly includes a housing 104 in which a web 12 of pre-moistened towelettes is supported on a spindle 112, a towelette dispensing assembly 106 is situated within housing 104 and configured for dispensing the towelettes one-by-one to users on demand, and a verification assembly 108 is positioned through housing 104 and configured for sensing system usage, to include data recording means, allowing employers to monitor how often their employees use dispenser system 2.

Figure 2:
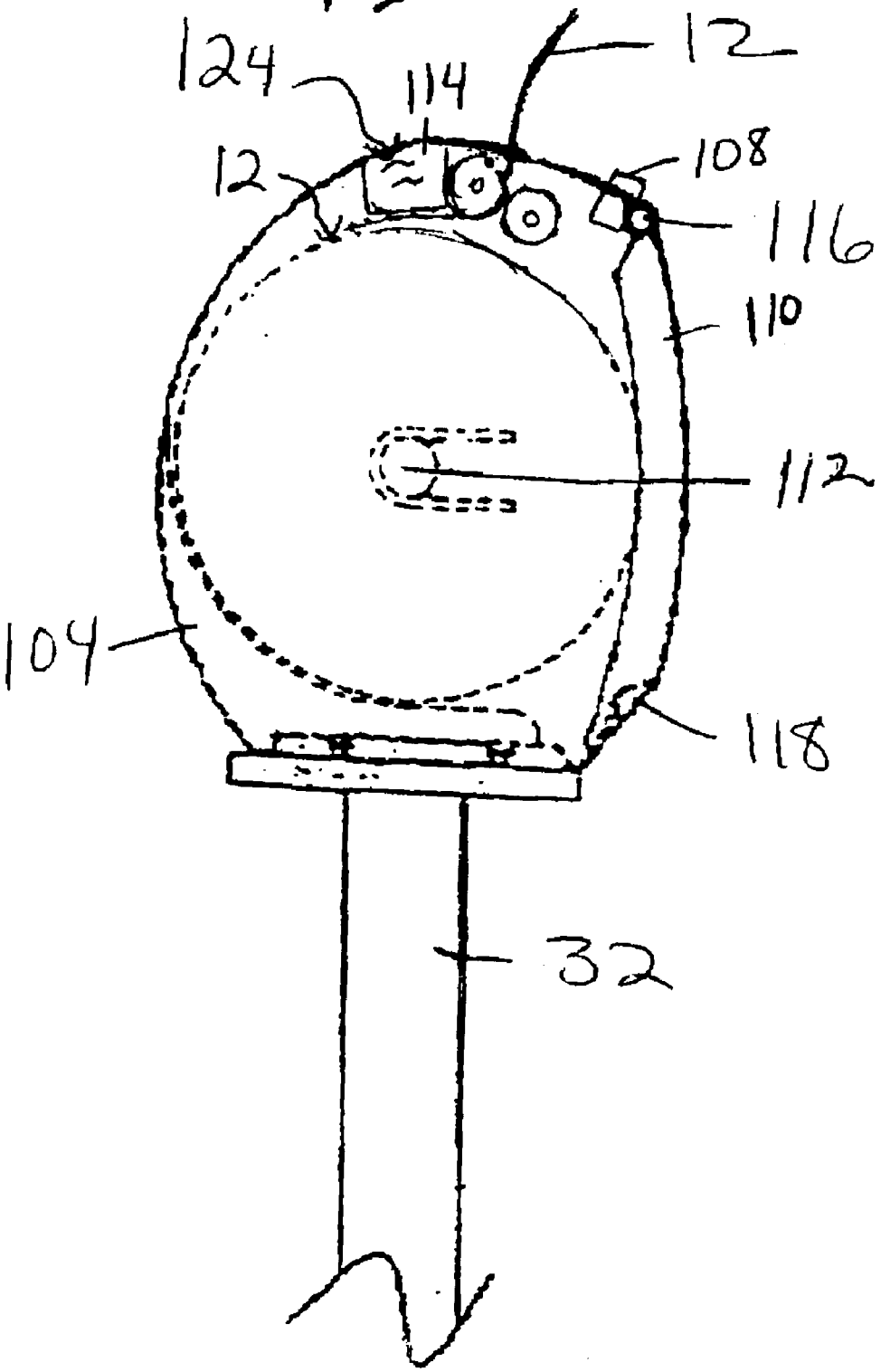
FIG. 2 is an end view of the dispensing apparatus in a pedestal mount.
Figure 3:
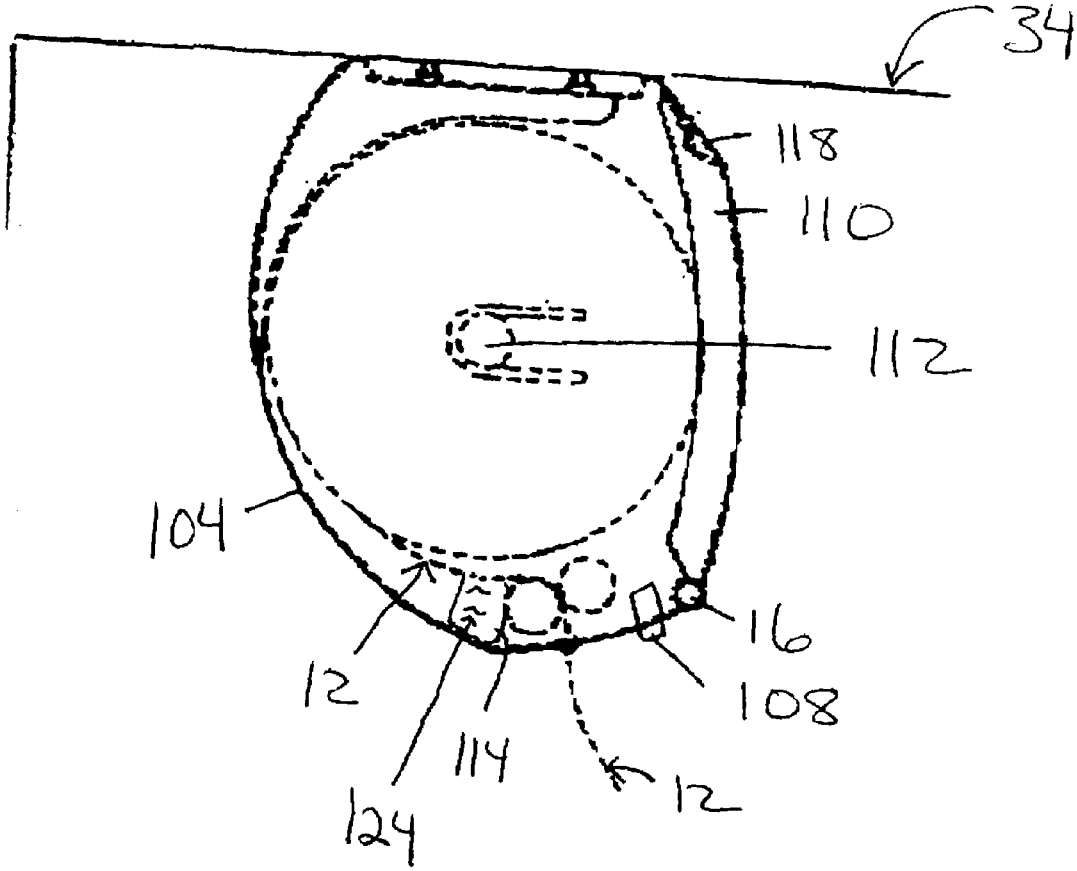
FIG. 3 is an end view of the dispensing apparatus in an under cabinet mount.

Housing 104 is of a size and shape that permits mounting in any number of different positions, such as on a table top 30 (as shown in FIG. 1), under a counter 34 (as shown in FIG. 3), on a pedestal 32 (as shown in FIG. 2), or on a wall (not shown), and it is contemplated for any conventional mounting structure to be employed to secure housing 104 in any of these orientations. For example, in FIG. 1, a rectangular housing 104 is shown, and in FIGS. 2 and 3 arcuate housings 104 are shown. In the most preferred embodiment, housing 104 is formed of a synthetic resin material or the like, and generally includes a panel 110, connected by means of a hinge 116 to housing 104, that may be opened to allow access to the interior of housing 104 and the various components supported therein, such as the web 12 of pre-moistened towelettes and spindle 112. Preferably, panel 110 is latched shut, and the latch 118 used (shown in FIGS. 2 and 3) is child-proof to prevent young children from tampering with dispensing system 2. The bottom wall 120 of housing 104 defines a base dispensing system 2, and includes a plurality of feet 102 on which housing 104 can rest when set upon a support surface, such as table top 30 in FIG. 1. Preferably, rubber shoes (not shown) are fitted on feet 102 to stabilize housing 104 during use, however, it is contemplated that other mounting means would also be suitable. The rubber shoes, and other mounting means, allow a variety of options for secure placement of housing 104. The different placement options include: on counter/desk (or the likes), as shown in FIG. 1; under cabinet, as shown in FIG. 3; on a pedestal, as shown in FIG. 2; on either front, left or right facing wall (not shown) in a bathroom stall.

The front wall 122 of housing 104, shown in FIG. 1, has an opening 24 through which the pre-moistened towelettes are dispensed. In addition, one or more apertures may be formed in front wall 122 and/or adjacent portions of side walls (not readily visible in FIG. 1) for receipt of one or more hand dryer vents, such as inlet vent 62 and outflow vent 64, as described below. Although not shown in FIGS. 1–3, front wall 122 can be imprinted with the words "Power of Prevention is in Our Hands", as well as very specific instructions for most effective use of the individual pre-moistened towelettes separated from web 12 and preferred hand drying methods to be used therewith. Optionally, the front wall of housing 104 can contain other motivational information and messages. In addition, housing 104 can be made to display plastic sheets (not shown) with specific instructions for effective hand decontamination when using, a sink and running water, along with other educational/motivational matter. Although not shown, it is contemplated for sturdy adhesive to be used for secure placement of plastic instruction sheets against housing 104, particularly when dispenser system 2 is mounted above a bathroom sink (not shown).

Although not shown, a handle can optionally be provided on the top of housing 104 for facilitating transport of dispenser system 2 between use locations. Preferably, the handle would be retractable from a recess formed in the top wall of housing, 104 such that the handle does not protrude from the recess until it is deliberately extended for use.

The pre-moistened towelettes are either provided in stack or wound on a roll and include a substrate impregnated with a suitable moistening composition. The substrate is formed of a fibrous material such as paper fiber, cotton fiber or the like, and is composed as a recyclable or biodegradable product that is sturdy, soft, absorbent, and flushable. The moistening composition is preferably a lotion including an antiseptic solution and may also include several other ingredients for preventing and treating dry skin. Although several conventional antiseptic agents are available for use in the moistening composition, many exhibit one or more limitations such as host toxicity, inactivation by organic matter, narrow spectrum of anti-microbial action, poor residual activity or, most critically, drying and irritation of the skin with frequent use. This last limitation is a major impediment to frequent hand cleansing, particularly in high-use settings such as in the health care field.

Preferably, the active ingredients used in the towelettes of the present invention include Triclosan, which reliably lyses bacterial membranes. In addition, the composition includes an array of known botanical compounds which, in addition to anti-microbial properties, demonstrate anti-fungal, anti-parasitic, anti-protozoan, and anti-larval activity without host toxicity. Botanical antiseptic compounds are preferred as they show enhanced anti-microbial activity in the presence of organic matter. Chemicals derived from plants also tend to act synergistically, thereby adding efficiency without adding cost.

The towelette-moistening compound also preferably includes various known herbs and essential oils which enhance skin integrity, health and appearance. For example, the composition may include vitamins, minerals and proteins that nourish skin cells, act as and anti-oxidant, stimulate circulation, fuel cellular regeneration, and soften, sooth and moisturize the skin, preventing and treating dryness, irritation, chapping, and cracked or infected skin. Such herbs and oils also may be selected for use in the moistening composition of the present invention to function as an astringent agent which aids the healing process by contracting tissue and limiting fluid loss, or to promote healing as they soothe and soften. Thus, the antiseptic cleansing lotion that makes up the moistening composition includes a select group of broadly germicidal, soothing, healing, and moisturizing botanical ingredients. In addition, the moistening composition should be chosen to dry quickly, without residue, so that it leaves the skin refreshed, hydrated, nourished, and protected, regardless of the frequency of use. Because aroma influences mood, selection of the scent for the towelette-moistening composition is also important and it should provide a positive reinforcement to the towelette user. The aromatic qualities of the moisturizing composition used in the towelettes should be chosen to provide a soothing, refreshing and revitalizing sense to the towelette user, so as to encourage repeated use.

The towelette support compartment 100 of the apparatus preferably fills substantially the entire interior space of housing 104, but may be made smaller by providing a plurality of walls that enclose compartment 100 as in the most preferred embodiment described above and illustrated in FIG. 1. The towelettes in dispenser system 2 are stored as a perforated web 12, and a spindle 112 or the like is provided in compartment 100 for support of web 12. It is contemplated for housing 104 to have a hinged panel 110 through one of the walls of housing 104 such that the interior of towelette support compartment 100 is accessible through panel 110 for loading of a fresh web 12 of towelettes into compartment 100 through panel 110.

The towelette dispensing assembly 106 functions to restrict manual removal of towelettes from web 12 and through the dispensing opening 24 at a rate faster than one towelette at a time, and broadly includes a travel limiting mechanism for limiting removal of web 12 from towelette storage compartment 100 in incremental lengths greater than one towelette at a time. If desired, assembly 106 may also include a coin-operated lock (not shown) that requires the depositing of coins before removal of towelettes from web 12 will be permitted.

Housing 104 also includes a second compartment 60 separate from the towelette storage compartment 100, and second compartment 60 can be used either as an additional storage area for towelettes prior to use, or as a location for a hand drying assembly 58. If the hand drying assembly 58 is employed, it is powered by the electrical circuitry used for operation of verification assembly 108, and an on/off switch (not shown) would be provided through housing 104 to activate assembly 58 for hand drying operation. As a further hand drying option, second compartment 60 could also be used to store paper towels.

Hand drying assembly 58 includes an inlet vent 62, an outlet vent 64, a passage 66 connecting inlet vent 62 to outlet vent 64, a fan 68 configured and adapted for drawing air into inlet vent 62 and forcing it from outlet vent 64, and a heating element 70 for warming the air as it travels through passage 66. A filter 72 is also provided for filtering the air before it is discharged from outlet vent 64. Grills and/or louvers are provided on inlet vent 62 and outlet vent 64 for safety and for permitting warm air to be discharged in any direction, and two or more outlet vents 64 can be connected to passage 66 to optionally allow multi-directional air discharge. If second compartment 60 is not used for receipt of hand drying assembly 58, a hinged panel door, such as hinged panel door 110, is fitted over the exterior opening in housing 104 otherwise usable to accommodate inlet vent 62 to outlet vent 64 to provide access to second compartment 60 so that a reserve supply of towelettes can be sanitarily stored and protected therein until needed for use.

As an alternative option for providing paper towels 78 for hand drying subsequent to hand cleansing with the pre-moistened towelettes from web 12 or other drying purposes, a paper towel support assembly 74 may also be provided on or in proximity to housing 104 at any desired location. The construction of paper towel support assembly 74 is preferably the same as that used for support of web 12. Likewise, a sanitary disposal assembly 82 may be mounted on or in proximity to housing 104, for permitting disposal of used towelettes.

In order for users to operate dispenser system 2, he or she would manually pull on the leading edge of the end-most towelette protruding from dispensing opening 24. As the towelette is removed, the travel limiting mechanism of assembly 106 is activated such that only a single towelette can be removed from housing 104 before web 12 is braked in a conventional fashion. As such, it is not possible to pull two or more pre-moistened towelettes from dispensing opening 24 in a single pull. Preferably, a timing mechanism (not shown) is also provided as part of assembly 106 for resetting the travel limiting mechanism so that after a predetermined time delay a subsequent pre-moistened towelette can be withdrawn.

The pre-moistened towelettes can be used to cleanse the user's hands, face, and other parts of the user's body, and is discarded after use. Thereafter, the user would dry his or her hands by activating hand drying assembly 58, when provided, or employing a paper towel 78 taken from paper towel support assembly 74, if provided.

Dispenser system 2 can be constructed so that it includes a towelette warming assembly as described above. Also, housing 104 can be constructed such that it is used to dispense towelettes that are stored dry, and pre-moistened for use as they are dispensed. In accordance with this embodiment, a wetting assembly 114, shown in FIG. 1, is provided in housing 104 which includes a wetting mechanism and a reservoir (not shown) for storing the moistening composition. The wetting mechanism included in wetting assembly 114 can also comprise mechanically or electronically actuated rollers, sprayers or the like, and be connected to a reservoir such that moistening liquid in the reservoir is transferred to the end-most towelette only as it is conveyed toward dispensing opening 24.

Verification assembly 108 is a means for sensing usage of dispenser system 2 so that an employer can monitor how often employees use it. Although not shown, in order to achieve such monitoring, badges must be worn by the employees, and a sensor that is part of verification assembly 108 must be mounted on or near housing 104 which is capable of detecting the presence of any associated badge when it is in the vicinity of housing 104 at the time of dispensing. Preferably, a switch is provided in association with the travelling mechanism such that each time a towelette is withdrawn from dispensing opening 24, a signal is generated that activates the sensor to detect the presence of a badge in proximity thereto. By identifying which badge is present each time a towelette is withdrawn, and by recording or saving such information in a conventional manner, it is possible to monitor how often a person wearing a particular badge has activated the apparatus. Such information can be used to reward employees exhibiting responsible hand cleansing, and to encourage infrequent users to improve their habits. Likewise, it can be used to design and implement behavior modification programs directed to the goal of sustained high frequency hand cleansing, as well as enable employers and those with hand washing facilities available to the public to cooperate with public health agencies in the common good of promoting public safety.

Although the present invention has been described with reference to the preferred embodiment illustrated in the attached drawings, it is noted that substitutions may be made and equivalents employed herein without departing from the scope of the invention as recited in the claims. For example, although the sensor discussed as being a part of verification assembly 108 was electronically activated by user badges, the sensor could also be a motion detector that would activate dispenser system 2.

I claim:

1. A portable commercial hands-free portable towelette dispensing system for one-at-a-time dispensing of pre-moistened antiseptic towelettes from a web that allows pre-moistened antiseptic towelettes to be made available primarily for hand cleansing purposes in locations needing improved means for controlling the primary mode of the spread of infectious disease resulting from direct and indirect contact transmission of infectious pathogens which occurs primarily before eating by hand transmission via a fecal-to-oral route, with material components of said dispenser system being designed to implement classical and operant conditioning, wherein during use of said dispenser system classical and operant conditioning strategies function to change undesirable and unhealthy human hygiene habits of users into desirable and healthy hygiene habits, in terms of both frequency and effectiveness of hand decontamination, said dispenser system comprising:

a web of disposable towelettes configured for dispensing from a roll, a moistening composition applied to said towelettes, with said moistening composition being adapted for preventing and treating dry skin, said moistening composition also having anti-microbial properties and demonstrating anti-fungal, anti-parasitic, anti-protozoan, and anti-larval activity without host toxicity;

a housing formed with a towelette dispensing opening, and a first compartment adapted to contain and support said web of towelettes on a roll;

dispensing means associated with said housing, said dispensing means being adapted for user-activated drawing of an end-most one of said pre-moistened antiseptic towelettes from said roll and dispensing it through said dispensing opening;

mounting means configured for making said housing adaptable to different environmental settings and placing said dispensing opening in alternative orientations; and a verification assembly associated with said housing that is configured to sense the presence of a user whereby usage trends revealed by said verification assembly can be employed to determine optimum housing locations and types of educational support needed for each environmental setting to change hand cleansing from a burden into an easy and pleasurable experience, toward the ultimate goal of a global reduction in the spread of infectious diseases caused by hand transmission of infectious pathogens via a fecal-to-oral route.

2. The dispensing system of claim 1, wherein said verification assembly comprises sensor means selected from a group consisting of sensors adapted to record data, sensors adapted to distinguish between different users of said system, sensors adapted to record information categorized according to each user of said system and sensors adapted to interact with badges worn by individuals.

3. The dispensing system of claim 1, wherein said mounting means is selected from a group consisting of feet with rubber shoes, pedestals, and mounting means adapted for under-cabinet placement.

4. The dispensing system of claim 1, wherein said housing further comprises a sanitary disposal assembly.

5. The dispensing system of claim 1 wherein said housing further comprises a hinged panel adapted for providing access to said first compartment.

6. The dispensing system of claim 5 wherein said hinged panel is secured by a child-proof latch.

7. The dispensing system of claim 1, wherein said housing further comprises a retractable handle.

8. The dispensing system of claim 1 further comprising a towelette warming means.

9. The dispensing system of claim 1 wherein said dispensing system is coin operated.

10. The dispensing system of claim 1 further comprising a paper towel holder attached externally to said housing.

11. The dispensing system of claim 1 further comprising a reservoir configured for containing said moistening composition, and wherein said moistening composition in said reservoir is applied to each said towelette as it is dispensed.

12. The dispensing system of claim 1 further comprising at least one information message attached externally to said housing.

13. A method for dispensing pre-moistened antiseptic towelettes one-at-a-time from a roll primarily for hand cleansing purposes in locations needing improved means for controlling the primary mode of the spread of infectious disease resulting from direct and indirect contact transmission of infectious pathogens which occurs primarily before eating by hand transmission via a fecal-to-oral route, with said method incorporating classical and operant conditioning strategies to change undesirable and unhealthy human hygiene habits of users into desirable and healthy hygiene habits, in terms of both frequency and effectiveness of hand decontamination, said method comprising the steps of:

providing a plurality of webs of disposable antiseptic towelettes configured for dispensing from a roll, a moistening composition adapted for preventing and treating dry skin and also having anti-microbial, anti-fungal, anti-parasitic, anti-protozoan, and anti-larval activity properties without host toxicity; a plurality of housings each having a towelette dispensing opening and a first compartment adapted to contain and support towelettes on a roll, towelette dispensing means associated with each of said housings, mounting means, pre-moistening means for said towelettes, and a plurality of verification assemblies that are configured to sense the presence of a user;

using said mounting means to adapt each of said housings to different environmental settings and place said dispensing opening into a pre-selected orientation selected to provide users with convenient access to said towelettes between the times of exposure to fecal contamination and commencement of eating;

affixing one of said verification assemblies to each of said housings in a position whereby the presence of a user attempting to access a towelette can be detected;

placing one of said webs of towelettes in each of said housings with the endmost one of said towelettes being positioned adjacent to said dispensing opening; and adjusting said dispensing means so that said towelettes are dispensed one-at-a-time;

whereby as each of said towelettes is dispensed, user information is collected so that usage trends revealed by said verification assemblies can be employed to determine optimum housing locations and types of educational support needed for each environmental setting to change hand cleansing from a burden into an easy and pleasurable experience, toward the ultimate goal of a global reduction in the spread of infectious diseases caused by hand transmission of infectious pathogens via a fecal-to-oral route.

14. The method of claim 13 wherein said verification assemblies each comprise sensor means selected from a group consisting of sensors adapted to record data, sensors adapted to distinguish between different users, sensors adapted to record information categorized according to each user, and sensors adapted to interact with a plurality of badges each configured for wearing by an individual.

15. The method of claim 13 further comprising a step of providing a sanitary disposal assembly for each said housing, and a step of disposing used ones of said towelettes into said sanitary disposal assembly.

16. The method of claim 13 wherein said towelette dispensing means further comprises a towelette warming means.

17. The method of claim 13, wherein said towelette dispensing means is coin operated.

18. The method of claim 13 further comprising a step of providing a paper towel holder for each said housing, and a step of attaching said paper towel holder externally to said housing.

19. The method of claim 13 further comprising a step of providing a reservoir for each said housing that is configured for containing said moistening compositions, and a step adding said moistening composition to each said towelette as it is dispensed.

20. The method of claim 13 further comprising a step of providing at least one information message for each said housing, and a step of attaching said information message externally to said housings.

* * * * *